US005358059A

United States Patent [19]

Ho

[11] Patent Number: 5,358,059

[45] Date of Patent: Oct. 25, 1994

[54] APPARATUS AND METHOD FOR THE DYNAMIC MEASUREMENT OF A DRILL STRING EMPLOYED IN DRILLING

[76] Inventor: Hwa-Shan Ho, P.O. Box 11170, Spring, Tex. 77391-1170

[21] Appl. No.: 126,657

[22] Filed: Sep. 27, 1993

[51] Int. Cl.[5] ..... E21B 47/12

[52] U.S. Cl. ..... 175/45; 175/50; 175/61

[58] Field of Search ..... 175/39, 45, 40, 41, 175/50, 61

[56] References Cited

U.S. PATENT DOCUMENTS

| | | | |
|---|---|---|---|
| 3,626,482 | 12/1971 | Billere et al. | 175/50 X |
| 3,820,063 | 6/1974 | Sexton et al. | 175/50 X |
| 4,647,853 | 3/1987 | Cobern | 175/45 X |
| 4,662,458 | 5/1987 | Ho | 175/27 |
| 4,773,263 | 9/1988 | Lesage et al. | 73/151 |
| 4,903,245 | 2/1990 | Close et al. | 367/81 |
| 4,958,517 | 9/1990 | Maron | 73/151 |
| 4,972,703 | 11/1990 | Ho | 175/45 X |
| 5,058,077 | 10/1991 | Twist | 367/25 |
| 5,113,953 | 5/1992 | Noble | 175/61 |
| 5,141,061 | 8/1992 | Henneuse | 175/56 |
| 5,159,577 | 10/1992 | Twist | 367/25 |
| 5,163,521 | 11/1992 | Pustanyk et al. | 175/61 X |
| 5,175,429 | 12/1992 | Hall, Jr. . | |
| 5,216,917 | 6/1993 | Detournay | 175/39 X |

OTHER PUBLICATIONS

Cunningham, Journal of Engineering for Industry, May 1968 pp. 208–216.

Huang et al., Journal of Engineering for Industry, Nov. 1968, pp. 613–619.

Besaisow et al., SPE, 1986.

Dareing et al., Journal of Engineering for Industry, Nov. 1968, pp. 671–679.

Milheim et al., SPE, 1980.

Burgess et al., SPE/IADC, 1987, pp. 517–530.

Jansen, J. D., SPE, 1990, pp. 435–448.

C. J. Langeveld, SPE, Dec. 1991, p. 3+.

*Primary Examiner*—Ramon S. Britts

*Assistant Examiner*—Frank S. Tsay

*Attorney, Agent, or Firm*—Harrison & Egbert

[57] ABSTRACT

An apparatus and method for use in determining drilling conditions in a borehole in the earth having a drill string, a drill bit connected to an end of the drill string, sensors positioned in a cross-section of the drill string axially spaced from the drill bit, and a processor interactive with the sensors so as to produce a humanly perceivable indication of a rotating and whirling motion of the drill string. The sensors serve to carry out kinematic measurements and force resultant measurements of the drill string. The sensors are a plurality of accelerometers positioned at the cross-section. The sensors can also includes a plurality of orthogonally-oriented triplets of magnetometers. A second group of sensors is positioned in spaced relationship to the first group of sensors along the drill string. The second group of sensors is interactive with the first group of sensors so as to infer a tilting of an axis of the drill string.

19 Claims, 3 Drawing Sheets

APPARATUS AND METHOD FOR THE DYNAMIC MEASUREMENT OF A DRILL STRING EMPLOYED IN DRILLING

TECHNICAL FIELD

The present invention relates to a method and apparatus for providing a more realistic and flexible interpretation of measurement-while-drilling data in order to better predict the direction of advance of the drill and provide better evaluation of the mechanical properties of the formations encountered.

BACKGROUND ART

To develop oil and gas resources, the drilling industry employs drill bits to bore the well. Traditionally, the long drill string is rotated at the surface location to drive the drill bit. The drill string is rotated either by the rotary table or a direct drive system, called the top drive. Alternatively, the drill bit may be rotatably driven by the employment of a downhole mud motor. Factors strongly influencing the rate of drilling the formation include the axial load and the torque by the bit on the formation, called WOB (weight-on-bit) and TOB (torque-on-bit) respectively.

The drill string also carries many tools and instruments, mostly downhole near the bit, particularly since the development of MWD (measurement-while-drilling) technology. These MWD subs are capable of measuring various drilling and formation property information, manipulating the information into compacted data, and transferring this data to the surface through various means, most typical of them is the mud-pulse telemetry. This transmitted data, while drilling or during tripping, provides great benefits by improving the drilling trajectory and drilling condition monitoring, and also by providing improved formation physical property evaluation when compared to the more traditional wireline logging, since the formation is freshly drilled and not as altered by the invasion of the drilling mud.

Due to various reasons such as misalignment, mass imbalance, inhomogeneity in the physical properties of the rock drilled, side-cutting of the drill bit, and/or the drill string's excitation due to contacts with the borehole wall during drilling and tripping, a drill string will exhibit dynamic vibrations which may have a combination of the following modes: axial, torsional and lateral bending vibrations. The lateral bending vibration under rotation of the shaft results in a "whirling" motion of the center of the drill string's cross-section.

Severe vibrations in such systems are very undesirable for many reasons. First, severe torsional and axial vibrations are transmitted to the surface, and may adversely affect the operating safety. Secondly, it will increase the repair and maintenance cost of the drill pipes, the downhole tools and subs, and may adversely affect their useful lives. Thirdly, it may adversely impact on the drilling efficiency leading to increased drilling cost. Fourthly, it may adversely impact on the quality and the trajectory of the well bore, resulting in increased risk of drilling crooked holes leading to stuck pipes and major drilling difficulties. This aspect is particularly important in directional (including horizontal and extended reach) wells. And finally, it may adversely affect the accuracy of the data measured by the downhole subs, complicating their interpretation, reducing and in some cases destroying their usefulness.

For these reasons, the drilling industry has had long-standing interest in the dynamic behavior of the drill string, and has carried out research through mathematical modeling and through measurements. The measurements have been carried out both at the surface and downhole. The pace of study on drill string dynamics has increased tremendously in the past ten years, coinciding more or less with the development of MWD technology. The current trend is toward intelligent monitoring of the downhole dynamic behavior of the drill string through downhole measurements, processing and data compaction, and appropriate interpretations.

To achieve these objectives, it is essential for the industry to perform the following tasks: (1) Place effective and sufficient sensors at desirable locations in the bottomhole assembly and/or at the surface; (2) Properly sample the data and correct for any significant errors in order to arrive at correct desired physical quantities describing the dynamic motion of the assembly; (3) Develop suitable analysis and recognition software models/routines that will enable downhole (and/or surface) processing of the above mentioned data; (4) Generate significant compacted downhole data describing key dynamic parameters that can be transmitted in real-time to the surface; and (5) Using the key transmitted downhole data or the interpreted surface data, modify the drilling program, if necessary, to ameliorate the downhole dynamics of the assembly, or to use this data for other modeling purposes.

In particular, the present invention emphasizes the measurements of the following parameters: (a) the torque and/or rotating speed (RPM), whether time-averaged or instantaneous; and (b) the whirling motion (describing the trajectory of the center of the shaft within the plane transverse to the axis of the shaft), which will induce bending stresses in the drill string.

The current measurement technology is, essentially, based on "separately" measuring either one or both of the above quantities. This is to say, when torque and/or RPM are measured, we assume the shaft does not whirl. Likewise, when shaft whirl is measured, we assume the shaft to be rotating with constant RPM and torque. In some situations, where vibration is mild, these may be reasonably good assumptions.

In the more general situations, a drill string will exhibit both rotating speed (and torque) fluctuations as well as whirling. Under such circumstances, two scenarios may happen: (a) The current methods may result in significant errors in the measured data, which may lead to erroneous interpretations of the observed behavior of the drill string; or (b) The current methods may result in insufficient information for the proper inference of the needed data describing the complex motion.

Various U.S. patents have issued in the recent past concerning the development of measurement-while-drilling (MWD) technology. Originally, U.S. Pat. No. 4,662,458, issued on May 5, 1987 to the present inventor. This patent describes a method and apparatus for obtaining complete loading on a drill bit at an end of a drill string in a borehole. At least three rosette strain gages were uniformly disposed on an instrument sub to measure torque and axial force on the sub, two bending moments in mutually perpendicular directions, and two shear forces in mutually perpendicular directions.

U.S. Pat. No. 4,773,263, issued on Sep. 27, 1988, to Lesage et al. teaches a method of analyzing vibrations from a drill bit in a borehole. In this patent, the frequency distribution spectrum of a vibrational quantity is measured from the impact of cutter teeth of the bottom of a bore. Spectra are obtained from the product of signals indicative of torque and torsional acceleration. Tooth wear is then indicated by the shift upwardly in frequency of peaks in the spectra.

U.S. Pat. No. 4,903,245, issued on Feb. 20, 1990, to Close et al. describes an apparatus for monitoring vibration of a bottom hole assembly which includes at least one accelerometer mounted in the bottom hole assembly to generate data in the form of electrical signals corresponding to the acceleration experienced by the assembly. The computer in the assembly is programmed to collect data from the accelerometers and compute magnitude of the assembly acceleration. Means are included for selecting from the collected data a value which exceeds a preset limit.

U.S. Pat. No. 4,958,517, issued on Sep. 25, 1990, to R. Maron shows an apparatus for measuring weight, torque, and side force (bending) on a drill bit. This apparatus includes radial holes which do not pass completely through the wall of the drill collar sub, but instead, pass only partially through the wall of the drill collar sub. Strain gages are located in the partial radial openings. These strain gages measure each of the three parameters of weight, torque and bending. For torque and bending measurements, the strain gages are arranged with symmetry of position between diammetrically opposed holes.

U.S. Pat. No. 5,058,077, issued on Oct. 15, 1991, to J. R. Twist provides a technique for generating a corrected well log. Sensor signals are generated at time intervals of less than one-half the period of the highest frequency of the periodic movement of the drill collar. Discrete sensor signals are averaged to generate an average sensor signal as a function of borehole depth. Discrete sensor signals are also are also recorded to generate a time-varying sensor signal profile, the magnitude of frequency components of the time-varying sensor signal profile is determined, and the average sensor signal is corrected as a function of the determined magnitude of the frequency components. The corrected sensor signals are preferably recorded as a function of borehole depth to generate a corrected well log.

U.S. Pat. No. 5,141,061, issued on Aug. 25, 1992, to H. Henneuse teaches a device for the auditory and/or visual representation of mechanical phenomena in the interaction between a drilling tool and the rock being drilled. A mechanism is provided for picking up a vibratory signal representing the vibration of the tool at the cutting face. An accelerometric sensor is provided at a specific point on the drilling stem. Processing equipment is provided for filtering the signal and the frequency band of 10 to 200 Hz.

U.S. Pat. No. 5,159,577, issued on Oct. 27, 1992, to J. R. Twist shows a technique for correcting signals from a downhole sensor on a drill collar eccentrically rotating within a borehole. The corrected sensor signal is used to generate a well log which more accurately represents the conditions which the sensor would have generated had the tool been rotating such that the spacing between the sensor and the borehole wall remains constant. The sensor signals are generated at time intervals of less than half the period of the rotation of the drill collar. The frequency components of the time-varying sensor signals are plotted, and the frequency component attributable to the eccentric rotation between the drill collar and the borehole may be determined. The techniques of this invention are used to determine actual rotational speed of the drill collar and the spacing between the sensor and the wall. This technique is used to determine a whirling condition in real time and to alter drilling parameters in response thereto.

U.S. Pat. No. 5,175,429, issued on Dec. 29, 1992 to Hall, Jr. et al. teaches a device for increasing the accuracy of measurement-while-drilling systems. A secondary measurement system is provided for determining the tool displacement from the borehole wall for calculated compensation of measurement data.

This aforestated technology is inadequate in determining the whirl motion. For example, U.S. Pat. No. 4,903,245 includes three eccentrically-mounted accelerometers along different axis, and two-axes magnetometers, in addition to the measurements of two-axes bending moments, the axial force, and the torsional moment.

It is an object of the present invention to provide an apparatus and method that is suitable for measuring kinematic and force resultant measurements.

It is another object of the present invention to provide an method and apparatus that allows calculations to be carried out which take into account the coexistence of both the torsional vibration and the whirling motion of the drill string.

It is a further object of the present invention to provide an method and apparatus that includes measurements required to calibrate for various sensor elements.

It is still another object of the present invention to provide an method and apparatus whereby measurement of rotational movement and whirling behavior of a drill string can be used for optimally controlling the speed and operation of the drill string.

These and other objects and advantages of the present invention will become apparent from a reading of the attached specification and appended claims.

SUMMARY OF THE INVENTION

The present invention is an apparatus for use in determining drilling conditions in a borehole in the earth that comprises a drill string, a drill bit connected to an end of the drill string, a measurement means positioned in a cross-section of the drill string axially spaced from the drill bit, and processing means interactive with the measurement means so as to produce a humanly perceivable indication of a whirling and rotating motion of the drill string. The measurement means is suitable for kinematic measurements and force resultant measurements of the drill string. The processing means serves to determine an instantaneous rotating speed and an instantaneous position of a center of the drill string. The measurement means, in one embodiment, comprises a plurality of accelerometers positioned at the cross-section. Alternatively, the measurement means can includes a plurality of orthogonally-oriented triplets of magnetometers. Still further, the measurement means also includes no less than three distance-infering sensors having a source and a receiver at each location of the sensor. Specifically, four of the distance-infering sensors are placed ninety degrees apart from one another at a circumference at the cross-section. Each of these sensors has a different carrier frequency. A second measurement means can be positioned on the drill string in spaced relation to the first measurement means along the drill string. The second measurement means is interactive with the first measurement means so as to infer a tilting of an axis of the drill string. A plurality of strain gage rosettes can be positioned at the cross-section of the drill string at generally equal intervals from each other. Not less than three strain gage rosettes are employed on the drill string.

The measurement means is positioned on a collar on the drill string at a single cross-section of the drill string. The kinematic measurements are distance, orientation, velocity, and acceleration of the drill string. The force resultant measurements are two-axes bending moments, two-axes shear forces, axial load, and torsion moment. The processing means serves to analyze the kinematic measurements and the force resultant measurements so as to determine a whirling motion and the dynamic behavior of the drill string.

The method of the present invention serves to measure and control the drilling of a borehole in the earth. This method includes the steps of (1) positioning a first plurality of sensors at a cross-section of the drill string axially spaced from the drill bit; (2) measuring an instantaneous rotating speed of the drill string with the sensors; (3) measuring an instantaneous position of a center of the drill string with the sensors; and (4) processing the instantaneous rotating speed and the instantaneous position so as to indicate a rotating motion of the cross-section of the drill string.

The step of positioning includes placing at least two accelerometers at diametrically opposite ends of the cross-section. The accelerometers serve to measure a rotating speed of the drill string. The step of positioning also includes placing four distance-infering sensors at equal intervals around a circumference of the cross-section, and setting each of the distance-infering sensors to a different carrier frequency. A cross-coupling effect can be determined between the distance-infering sensors on the drill string.

The method of the present invention further includes the steps of: (1) positioning another plurality of sensors at another cross-section of the drill string axially spaced from the first plurality of sensors; and (2) processing another instantaneous rotating speed and another instantaneous position of a center of the drill string at the other cross-section so as to determine a tilting of an axis of the drill string,

DETAILED DESCRIPTION OF THE INVENTION

In order to completely define the dynamic behavior of a bottom hole assembly, it is necessary to complete the measurements of two groups: (1) kinematic measurements and (2) force resultant measurements. The kinematic measurements include distance, orientation, velocity, and acceleration measurements. The kinematic measurements are obtained from a combination of the following sensors: magnetometers, velocity sensors, accelerometers, acoustic sensors, optical sensors, resistivity or electromagnetic sensors. The force resultant measurements include two-axes bending moments, two-axes shear forces, and axial load (otherwise known as WOB, the weight on bit), and the torsion moment (called TOB, the torque on bit). The manner of obtaining force resultant measurements are fully described in U.S. Pat. No. 4,662,458, by the present inventor, and is incorporated by reference hereto.

In addition to the taking of the kinematic and force resultant measurements, it is also necessary to link these two groups in a manner that allows the interrelationship to be inferred in an unequivocal manner. In order to achieve this objective, it is preferable that these two groups of data be measured at the same cross-section axially spaced from the bit. Under such a situation, it is possible to use the axial location as a reference point. As a result, the relevant dynamic parameters can be inferred at other locations axially spaced from this reference location.

Current technology uses the following common type of sensors: strain gages; accelerometers; and magnetometers. The strain gages are used to infer the force resultants, namely the axial force, the shear forces, the torque, and the bending moments, at the cross-section of the drill string. The accelerometers are used to measure the three-component accelerations. The magnetometers are used to infer the orientation angles of the drill string's axial direction and the tool face angle. In the prior art, attempts have been made to infer the whirl motion from the bending moment inferred from the strain gages. The key to whirl determination is displacement measurement/inference. To accomplish this, several techniques are possible. It is possible to use any of the following types of sensors for this purpose, resistivity sensors, acoustic sensors, optical sensors, or electromagnetic sensors.

Figure 1:
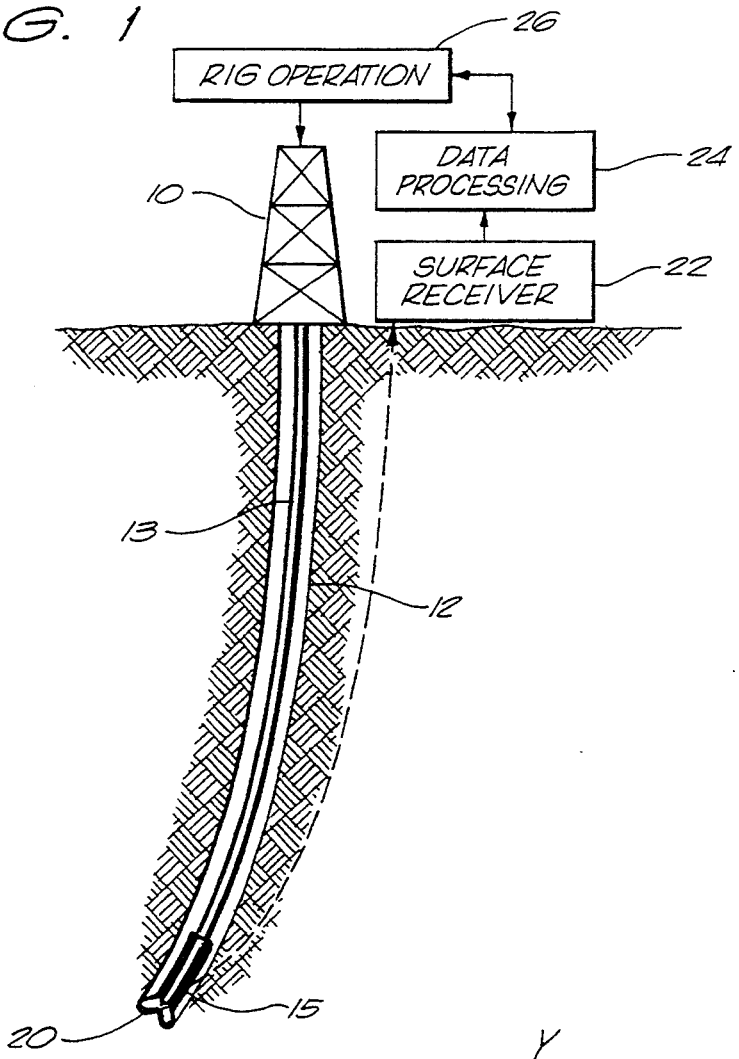
FIG. 1 is a diagrammatic representation of a well being drilled and controlled in accordance with the teachings of the present invention.

The diagrammatic representation of FIG. 1 shows a land-based drilling rig 10 used for drilling a borehole 12 and from which rig a drill string 13 is suspended with a bottom hole assembly 15 at the lower end. The present invention is equally adaptable to offshore drilling and is not restricted to a land-based configuration, which is used for illustration purposes only. The actual drilling can be accomplished by either of two known methods of drilling, namely driving the drill pipe 13 from the surface or having the bottom hole assembly 15 provided with a motor so as to drive the drill bit. In the present example, the downhole assembly 15 is shown as including a bit 20, a motor to drive the bit, an instrumentation sub, an orienting sub or stabilizer, and a transmitter. The data is transmitted by telemetry means, which may be through hard wire, mud pulse, sonic wave, or electromagnetic wave, or radio frequency to a surface receiver 22 which, in turn, is connected to a data processing unit 24 and a rig operation system 26.

The borehole will have three components, X, Y and Z. X is the direction, Y is the inclination, and Z is the axis of the borehole. The forces and moments are measured on the bottom hole assembly 15 and the bit 20 by an array of strain gages. These measurements are transmitted to the receiver 22 at the surface and then to the data processer 24. The measurements will show the side forces and moments and, by knowing the components, the amount the bit will cut sideways in the next length of borehole drilled can be determined. The actual measurement of the forces can show many things to a driller. For example, a high side force on the bit could indicate high curvature in the hole, the possibility of a transition zone or the start of a dogleg situation, all of which would require corrective action.

Figure 3:
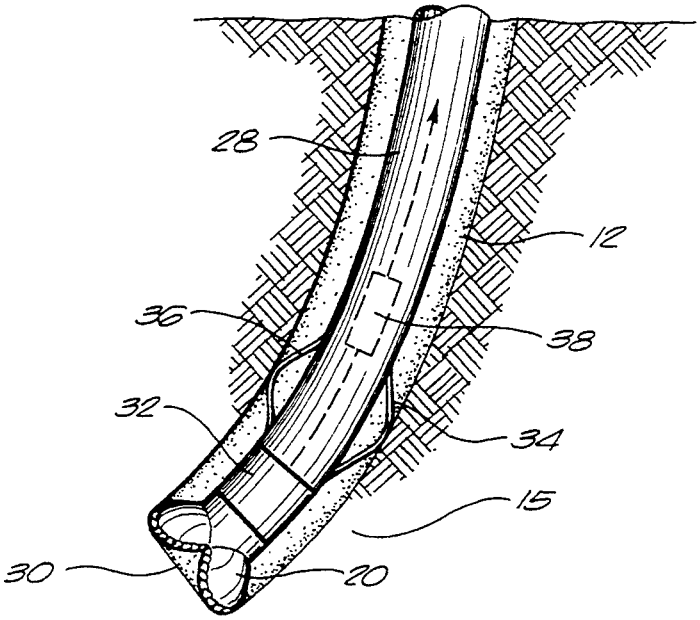
FIG. 3 is a diagrammatic representation of a downhole assembly incorporating the teachings of the present invention.

Referring to FIG. 3, the details of the downhole assembly 15 are particularly illustrated. It can be seen that the downhole assembly 15 is positioned within the borehole 12. The drill bit 20 is affixed to the ends of the drill string 28. In normal use, a motor will be connected to the drill bit 20 so as to rotate the drill bit for the purpose of drilling the borehole 12.

In normal operation, the resistances and impact made by the drill bit 20 at the bottom 30 of the borehole 12 will create forces on the drill string 28. In the prior art, these forces have been measured through the use of strain gage rosettes. The forces that are measured include the axial force, the torque, the two-axes shear forces and the two-axes bending moments. Unfortunately, the measurement of these forces does not completely model and show the movement and action of the drill string 28. In normal use, the drill string 28 will have a "whirling motion" within the borehole 12. The "whirling" motion causes the drill string 28 to rotate and flex within the borehole 12. At certain points during the rotation of the drill string 28, the walls of the drill string 28 will come into proximity with the walls of the borehole 12. The distortion of the drill string 28, caused by this whirling, can distort the data that is being transmitted from the formation evaluation sensors including gamma, resistivity, neutron density, porosity and sonic sensors, located on the bottom hole assembly 15. In order to properly measure and model the action of the drill string 28 within the borehole 12, it is necessary to incorporate the whirling motion of the drill string 28 into the data that is transmitted to the surface receiver 22 and the data which is processed by the data processer 24.

In FIG. 3, it can be seen that an instrumentation sub 32 is positioned adjacent to the drill bit 20, and to the motor associated with the drill bit 20. Stabilizers 34 and 36 are provided on the drill string 28 so as to urge the drill string 28 into a generally centered position within the borehole 12. A transmitter 38 interconnected to the instrumentation sub 32 is provided so as to transmit the data to the surface. The transmitter 38 is illustrated as located within the drill string 28 and provides downhole processing and telemetry to the surface. As used herein, the instrumentation sub 32 is considered to be part of the drill string 28.

Figure 2:
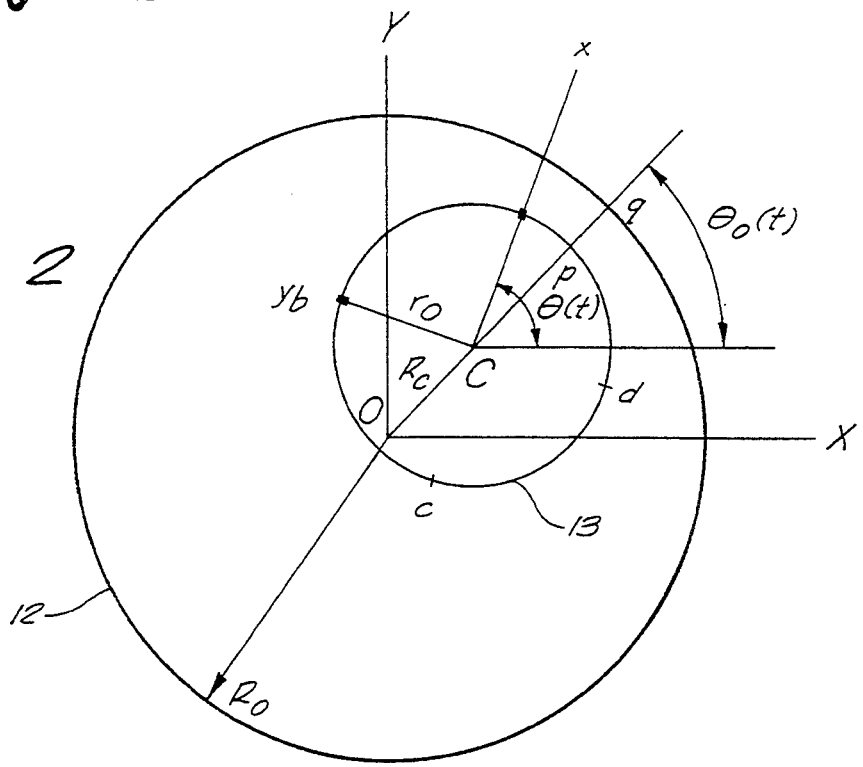
FIG. 2 is a diagrammatic representation of the interior of a borehole showing the whirling motion of a drill string therewithin.

Referring to FIG. 2, it can be seen that the borehole 12 is diagrammatically illustrated. The drill string 13 is shown as positioned within the borehole 12. FIG. 2 serves to describe the whirling geometry of the drill string 13 at the cross-section where the sensors are to be placed. As shown in FIG. 2, $r_o$ the radius of the shaft. $R_c$ is the radius of the confining circle, such as the outer casing of the motor or the bearing of the shaft or the borehole of a drill string. Essentially, $R_c$ is the eccentricity (or the radius) of the whirl motion. X and Y are the referenced fixed lateral directions. The letters x and y are the rotating lateral directions attached to the shaft at points a and b (where the sensors may be placed). The whirl motion is described by the eccentricity $R_c$ and the whirl orientation angle $\Theta_o(t)$. The torsional motion of the shaft is described by the rotating orientation angle $\Theta(t)$ between the rotating x-axis and the fixed reference X-axis. A complete description of the rotating dynamics of the shaft requires the inference of the three time-dependent quantity $R_c$, $\Theta_O$, and $\Theta$, through appropriate measurements.

The simplest situation for the drill string 13 is a steady-state rotation represented by the following: $R_c(t)=O$, and $\Theta(t)=A+\omega t$; where $\omega$=constant is the rotating speed of the shaft. In this situation, the whirl orientation angle $\Theta o(t)$ is immaterial, and the shaft is concentric to the confining circle. Under such ideal dynamic motion, the only sources of measurement errors are the sensor placement error and the timing error.

In situations where the torsional vibration is excited, $(t) = d\Theta(t)/dt$ will be fluctuating in time. In order to identify both the whirling and vibrational vibrations, it is necessary to have sufficient data and the types of sensors that are located appropriately. It is necessary to apply appropriate measuring techniques and to correct for any intrinsic errors as well as cross-coupling effects, in order to have physically correct quantities. For the purposes of the present invention, the ability to properly measure the whirling and rotational vibration of the drill string 13, it is necessary to not assume constant angular rotation, to not assume non-whirling configuration, to provide a means of measuring instantaneous rotation, to provide a means of measuring and inferring instantaneous whirling motion which is itself dependent on the instantaneous rotation, to provide a means of separating any cross-coupling effects, and to provide a means of eliminating and/or reducing the inherent errors.

Figure 4:
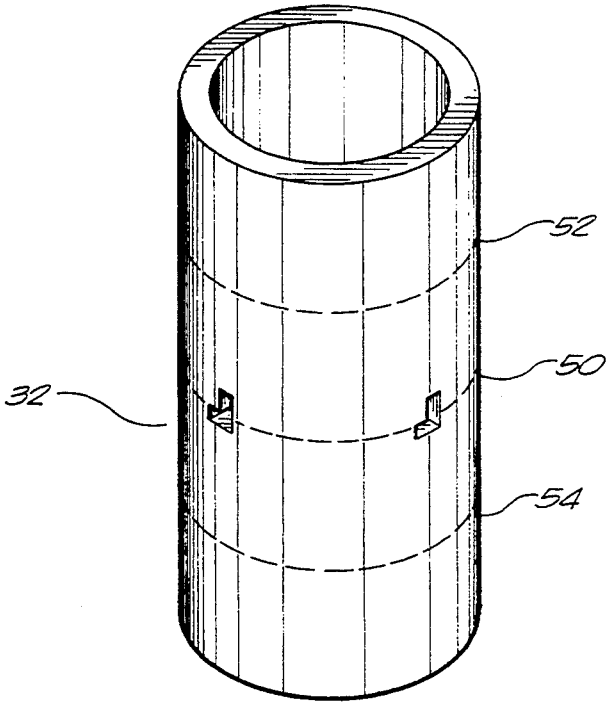
FIG. 4 is a diagrammatic perspective view of a portion of an equipment sub showing the sensor locations placed around the circumference of the sub.

In FIG. 4, there is particularly illustrated the instrumentation sensor sub 32 in accordance with the present invention. The instrumentation sensor sub 32 includes a force sensor ring 50, and the kinematic sensor rings 52 and 54. The kinematic sensor ring 52 and 54 serve to provide complete kinematic measurements and interpretation. The rings 52 and 54 serve to determine simultaneously the instantaneous rotating speed and the instantaneous position of the center of the drill string. The location of the proper sensors in the kinematic sensor rings 52 and 54 will fully describe the rotating and whirling motion of a cross-section of the drill string to which the instrumentation sub 32 is attached.

It can be seen that the instrumentation sensor sub 32 is essentially a collar that is fitted to the drill string 13. Although two kinematic sensor rings 52 and 54 are illustrated, it is possible to carry out the present invention with a single kinematic sensor ring. The axially displaced and parallel arrangement of the kinematic sensor rings 52 and 54 serve to allow the inferring of the tilting of the drill string axis.

Figure 5:
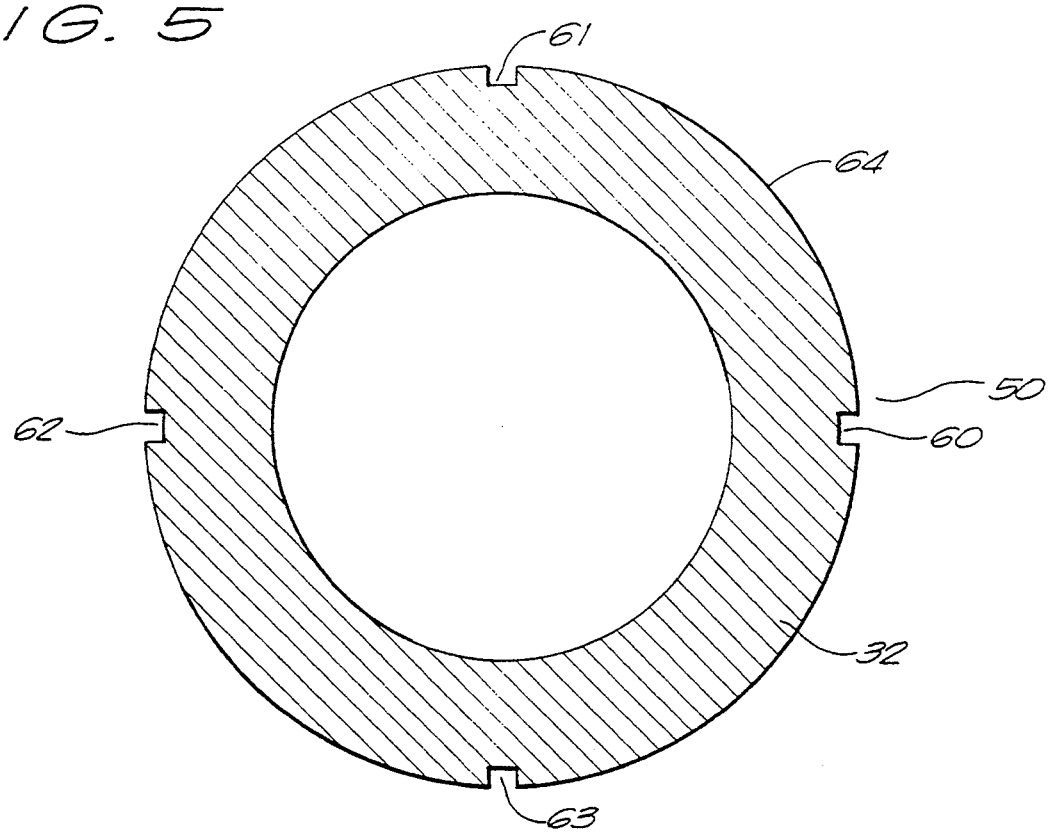
FIG. 5 is a cross-sectional view of a force sensor ring showing the location of the strain Gage rosettes.

FIG. 5 is a cross-sectional view of the force sensor ring 50. It can be seen that the force sensor ring 50 includes insert areas 60, 61, 62, and 63 for the attachment of strain gage rosettes. In the preferred embodiment, a total of four strain gage rosettes are positioned at equally spaced intervals around the circumference 64 of the instrumentation sub 32. However, in keeping with the present invention, it is possible that three strain gage rosettes can be placed around the circumference 64. The strain gage rosettes should be compensated for temperature and pressure through commonly known methods, such as a Whirstone bridges. The force sensor ring 50 serves to measure the axial force, the torque, the two-axes shear forces and the two-axes bending moments. It can be seen that the strain gage rosettes are placed in a single cross-section of the drill string.

The complete load measurement by the force sensor ring 50 is made spaced from the bit 20 but will enable determination of the bit moments and the force components by standard structural mechanics. In accordance with the present invention, these measurements can be made in an instrument sub adjacent the bit, as shown, or at a point above an orienting sub or stabilizer 36.

The purpose of making the force sensor measurements is to enable computation of the bit side forces and bit bending moments while drilling. This cannot be done by simple bending moment measurements or simple shear force measurements alone, as taught by the prior art. Bit bending moments are particularly significant when drilling into changing lithology or when building or dropping the borehole direction during directional drilling. Knowing the bit side forces is important in predicting the bit advance direction during directional drilling. In a measurement-while-drilling environment, successive comparisons of the measured side forces to the calculated side forces will provide the driller with a great deal of information about the formation being drilled.

Figure 6:
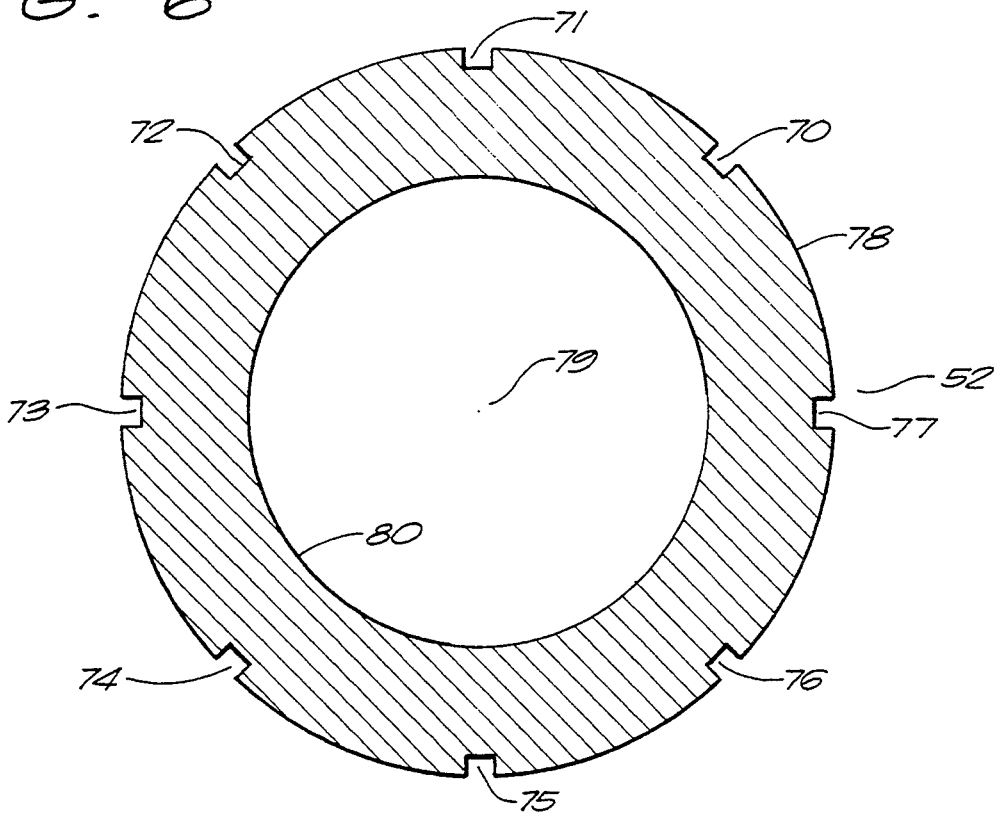
FIG. 6 is a cross-sectional view of a kinematic sensor ring showing the location of the accelerometers and distance-infering devices.

FIG. 6 is a cross-sectional view of the kinematic sensor ring 52. The kinematic sensor ring 52 is positioned in a location generally parallel to and axially spaced from the force sensor ring 50. The kinematic sensor ring 52 includes a plurality of openings 70, 71, 72, 73, 74, 75, 76, and 77. The openings 71, 73, 75 and 77 receive accelerometers therein. The openings 70, 72, 74, and 76 serve to receive distance-inferring devices. As can be seen, the accelerometers and the distance-infering devices are arranged along the same cross-section of the instrumentation sub 32.

The accelerometers are positioned at four locations around the circumference 78 of the instrumentation sub 32. However, it is possible within the scope of the present invention that a minimum of two accelerometers can be placed at diametrically opposite ends of the cross-section of the drill string or the assembly. The use of the accelerometers allows the instantaneous value of rotation speed to be deduced through known formulations in the dynamics literature. Alternatively, instead of the use of accelerometers, the rotation speed may be determined by the placement of orthogonally-oriented triplets of magnetometers in the openings 71, 73, 75 and 77. Alternatively, the magnetometers can be placed on the instrumentation sub 32 or at the center of the bore 79. In such a situation, fluid will pass around the magnetometers. This is otherwise known as the "Sonde" configuration. Each of the magnetometers can be supported from the interior diameter 80 at the bore 79. The accelerometers or magnetometers can properly be used so as to measure the instantaneous rotating speed of the drill string.

In order to obtain an instantaneous measurement of the center of the drill string, it is necessary to incorporate the distance-inferring sensors into the openings 70, 72, 74, and 76 of the instrumentation sub 32. Although a total of four of the distance-infering sensors are illustrated in FIG. 6, it is possible that a minimum of three sensors can be used. If three sensors are used, then the sensors should be spaced at equal intervals around the circumference 78 of the kinematic sensor ring 52. These distance-infering sensors are known in the prior art. These sensors can be resistivity sensors, sonic-type sensors, or optic sensors. In each of these circumstances, a source and a receiver are placed in each of the sensor locations 70, 72, 74 and 76. The use of the distance-infering sensors essentially transmits a sensor signal to the wall of the borehole so as to provide information as to the distance between the sensor and the wall of the borehole. Ideally, each of the sensors should have a different carrier frequency so as to facilitate the determination of the cross-coupling effects between the various sensors. If sensors of the same frequency are used, then it can often become difficult to properly sort the signals or to overcome the cross-coupling effects for the purpose of creating accurate data. Also, in the preferred embodiment of the present invention, a total of four distance-infering sensors are placed at ninety degrees apart from one another around the circumference 78. Through the use of the distance-infering sensors, and instantaneous position of the center of the drill string can be determined. Under the present invention, it is important to realize that the inference of the center of the cross-section of the drill string does not assume a constant rotation speed.

With reference to FIG. 4, it can be seen that the kinematic sensor ring 52 is placed in parallel relationship to a second kinematic sensor ring 54. The kinematic sensor ring 54 can have a configuration similar to that shown in FIG. 6. The kinematic sensor ring 54 should be identical to the kinematic sensor ring 52. This arrangement allows the tilting of the drill string axis to be properly inferred.

In the present invention, any intrinsic errors due to sensor misalignment and timing differences are accounted for through prior calibration and by automatic correction. The timing error may further be avoided by true simultaneous signal sampling through the use of sample-and-hold circuits whenever practicable. The data processor 24 and the surface receiver 22 will receive the transmitted signal from the transmitter 38 so as to produce data and to manipulate data capable of generating the instantaneous rotating speed at location of the center of the drill string section. Other signal processing may be carried out in both the frequency domain and the time domain in order to yield further important characteristics of the kinematic of the drill string motion. The data manipulation may be performed either at the sensor collection sub or at the surface, when possible.

In the present invention, the force sensor ring and the kinematic sensor rings are combined so as to facilitate analytical and/or numerical modeling. The present invention serves to further clarify the interrelationship of these dynamic quantities and to enable evaluation of the dynamic behavior at other locations axially spaced from the sensor locations. The present invention is an integrated system of drill string dynamics measurement, analysis, and diagnosis. The present invention is an advisory system wherein all of the above information is processed and monitored on a real-time or quasi real-time basis. The present invention allows the drill string operator to avoid excessive vibration of various kinds, including stick-slip, whirling, parametric excitation, and resonance. Whenever any such adverse conditions are detected, the drilling parameters, particularly the revolutions per minute and the weight-on-bit may be varied to achieve a reduction or elimination of these adverse phenomena.

The foregoing disclosure and description of the invention is illustrative and explanatory thereof. Various changes in the details of the illustrated construction, or in the steps of the described method, may be made within the scope of the appended claims without departing from the true spirit of the invention. The present invention should only be limited by the following claims and their legal equivalents

I claim:

1. An apparatus for use in determining drilling conditions in a borehole in the earth comprising:

a drill string having a top end and a bottom end;

a drill bit connected to a bottom end of said drill string;

measurement means positioned in a cross-sectional area of said drill string, said cross-sectional area being transverse to a longitudinal axis of said drill string, said measurement means for taking measurements of a motion of said drill string and force resultant measurements of said drill string at said cross-sectional area; and processing means interactive with the measurements taken by said measurement means so as to produce a quantified indication of a rotating and whirling motion of said drill string.

2. The apparatus of claim 1, said quantified indication of said processing means being an instantaneous rotating speed and an instantaneous position of a center of said drill string.

3. The apparatus of claim 1, said measurement means comprising a plurality of accelerometers positioned at said cross-section.

4. The apparatus of claim 1, said measurement means comprising a plurality of orthogonally-oriented triplets of magnetometers.

5. The apparatus of claim 2, said measurement means comprising no less than three distance-infering sensors, each of said sensors having a transmitter and a receiver.

6. The apparatus of claim 5, said measurement means comprising:

four of said distance-infering sensors placed at ninety degrees apart from one another along a circumference at said cross-sectional area.

7. The apparatus of claim 1, further comprising:

a second measurement means positioned on said drill string in spaced relationship to said first measurement means along said drill string, said second measurement means interactive with said first measurement means so as to infer a tilting of an axis of said drill string.

8. The apparatus of claim 1, said measurement means comprising:

a plurality of strain gage rosettes positioned at a cross-sectional area of said drill string at generally equal intervals from each other, said plurality of strain gage rosettes being not less than three.

9. The apparatus of claim 1, said measurement means being positioned at a single cross-sectional area of said drill string transverse to the longitudinal axis of said drill string.

10. The apparatus of claim 1, said measurements of the motion being distance, orientation, velocity and acceleration of said drill string, said force resultant measurements being two-axes bending moments, two-axes shear forces, axial load, and torsion moment.

11. An apparatus for use in determining drilling conditions in a borehole in the earth comprising:

a drill string having a top end and a bottom end;

a drill bit connected to a bottom end of said drill string;

no less than three distance-inferring sensors, each of said sensors having a transmitter and a receiver, each of said distance-infering sensors positioned in a cross-sectional area of said drill string transverse to a longitudinal axis of said drill string, each of said sensors having a different carrier frequency; and processing means interactive with said distance-infering sensors for determining an instantaneous position of a center of said drill string.

12. The apparatus of claim 11, said distance-infering sensors comprising:

four distance-infering sensors placed ninety degrees apart from one another along a circumference of said cross-sectional area.

13. A method of measuring and controlling drilling of a borehole in the earth by a drill string having a bottom hole drilling assembly having a drill bit connected to a lower end of the drill string, the method comprising the steps of:

positioning a first plurality of sensors at a cross-sectional area of said drill string transverse to a longitudinal axis of said drill string;

measuring an instantaneous rotating speed of said drill string with said sensors;

measuring an instantaneous position of a center of said drill string with said sensors; and processing said instantaneous rotating speed and said instantaneous position so as to indicate a rotating and whirling motion of said cross-section of said drill string.

14. The method of claim 13, said step of positioning comprising:

placing accelerometers at diametrically opposite sides of said cross-sectional area 15. The method of claim 14, said step of positioning comprising:

placing four distance-infering sensors at equal intervals around a circumference of said cross-sectional area; and setting each of said distance-infering sensors to a different carrier frequency.

16. The method of claim 15, further comprising the step of:

determining a cross-coupling effect between said distance-infering sensors on said drill string.

17. The method of claim 13, further comprising the steps of:

positioning another plurality of sensors at another cross-sectional area of said drill string axially spaced from said first plurality of sensors; and processing another instantaneous rotating speed and another instantaneous position of a center of said drill string at said another cross-sectional so as to determine a tilting of an axis of said drill string.

18. The method of claim 13, further comprising the step of:

transmitting the processed speed and position information to a surface location above said cross-sectional area.

19. The method of claim 13, further comprising the steps of:

placing a plurality of strain gage rosettes at another cross-sectional area of said drill string, each of said rosettes positioned at equal intervals from an adjacent rosette;

determining resultant force data for axial force, torque, two-axes shear forces, and two-axes bending moments from said rosettes; and processing said resultant force data with said instantaneous rotating speed and said instantaneous position.

* * * * *